US005088711A

United States Patent [19]

Newsome

[11] Patent Number: 5,088,711

[45] Date of Patent: Feb. 18, 1992

[54] MACHINE FOR TRANSPORTING AND LOADING SIGNATURES

[76] Inventor: John R. Newsome, c/o Sim Products, R.R. #1 P.O. Box 58A, Shumway, Ill. 62461

[21] Appl. No.: 572,765

[22] Filed: Aug. 27, 1990

[51] Int. Cl.[5] ..... B65H 39/02

[52] U.S. Cl. ..... 270/54; 270/58; 414/795.8; 271/3.1; 271/216

[58] Field of Search ..... 270/52, 54, 58; 414/795.8; 271/3.1, 216, 149

[56] References Cited

U.S. PATENT DOCUMENTS

| | | | |
|---|---|---|---|
| 3,683,758 | 8/1972 | Feldkamper | 271/3.1 |
| 3,690,650 | 9/1972 | Maier | 414/795.8 |
| 3,900,115 | 8/1975 | Kumagai | 271/3.1 |
| 3,905,490 | 9/1975 | Johnson | 271/3.1 |
| 3,955,686 | 5/1976 | Kumagai | 271/3.1 |
| 4,049,259 | 9/1977 | Ventz | 271/3.1 |
| 4,771,896 | 9/1988 | Newsome | 271/3.1 |
| 4,981,292 | 1/1991 | Cosgrove | 270/54 |

FOREIGN PATENT DOCUMENTS

| | | | |
|---|---|---|---|
| 59416 | 1/1975 | Canada | 271/3.1 |

*Primary Examiner*—Edward K. Look
*Assistant Examiner*—Therese M. Newholm
*Attorney, Agent, or Firm*—Leydig, Voit & Mayer

[57] ABSTRACT

Magazine signatures which are manually loaded as a stack into a product hopper are stripped therefrom and are conveyed as a rough and non-uniform shingle to an accumulating hopper while being elevated from a low level to a substantially higher level. The signatures are stripped from the accumulating hopper and are formed into a thin and uniform running shingle with a comparatively large setback for transport along a horizontal path to a receiver hopper which is located at a relatively high elevation to feed the collating conveyor of a binding machine. The shingles are fed on an on-demand basis both to the accumulating hopper and to the receiver hopper in order to keep stacks of consistently low height and weight in the hoppers and thereby promote consistent stripping of shingle signatures from the hoppers.

11 Claims, 9 Drawing Sheets

47
AIR
46
43
40
8
72
44
77
6
73
48
71
74
32
49
56
32
8
FLOW
70
69
77
6
7
53
73
40
49
75
32
50
75
48
51
52
53
54
55
7
69
69

40
69

Fig. 9.
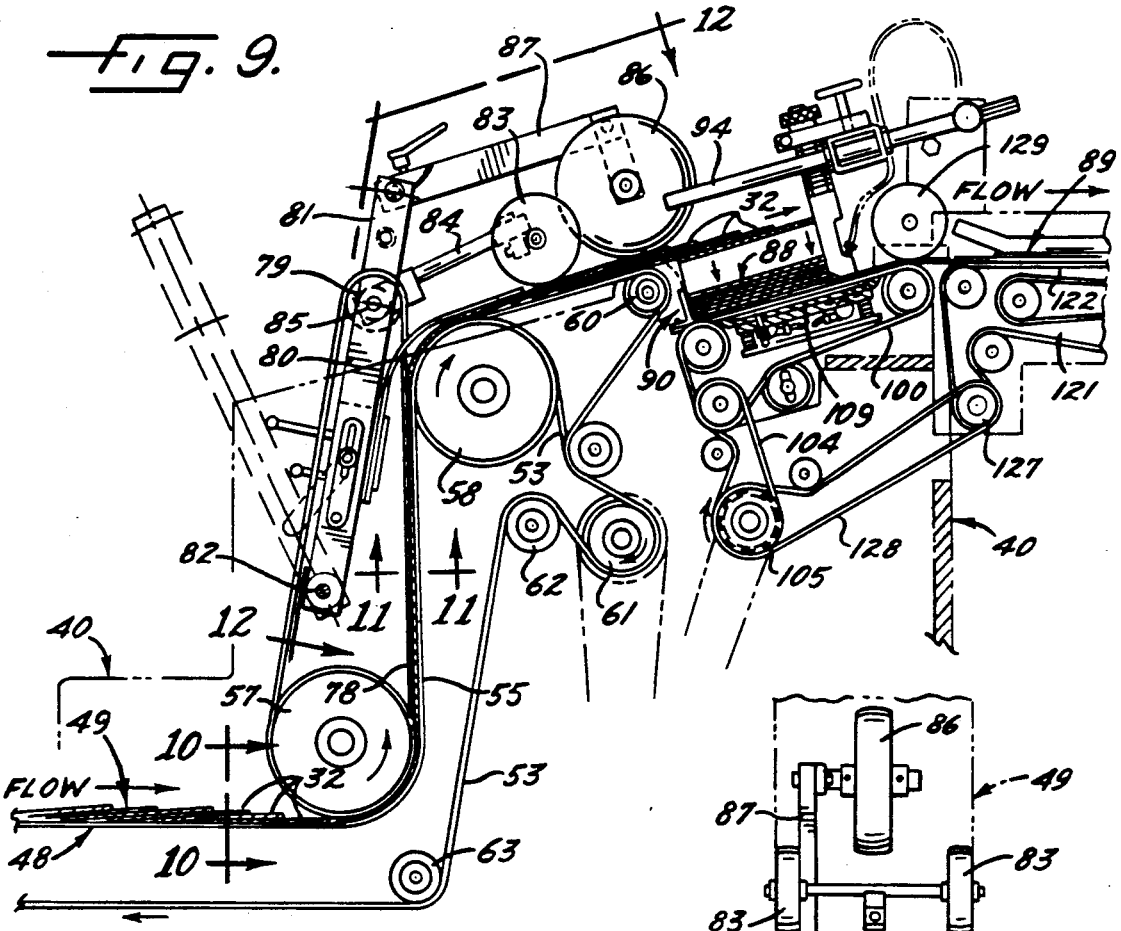
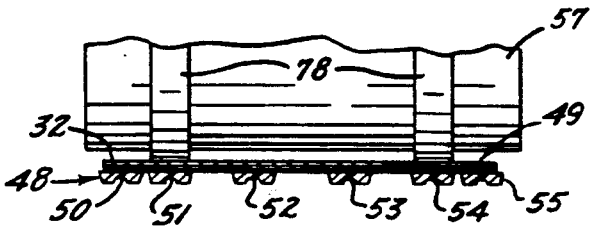
Fig. 10.
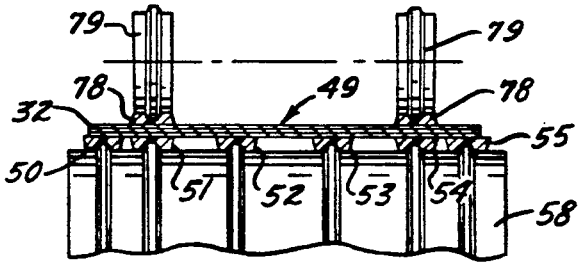
Fig. 11.
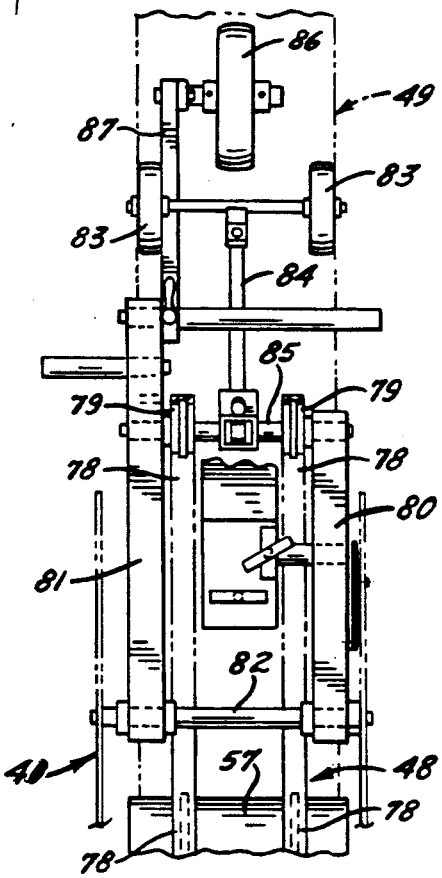
Fig. 12.

MACHINE FOR TRANSPORTING AND LOADING SIGNATURES

BACKGROUND OF THE INVENTION

The present invention relates to a machine for transporting paper signatures or the like to a processing line such as the collating conveyor of a binding machine.

Conventionally, the pages of magazines are supplied from the printing operation to the binding operation in the form of several groups of signatures, a signature being a multiple sheet folded assembly having a spine defined by the folded margin. At the binding operation, the groups of signatures are collated and bound to form the magazine.

In some binding operations, the groups of signatures are supplied to the bindery on pallets. Workers lift stacks of signatures from the pallets and place the stacks into receiver hoppers which supply the collating conveyor of a binding machine. During lifting and placing of the stacks, the workers fan and massage the signatures to loosen the signatures and help keep the newly printed signatures from sticking together during further processing.

Typically, the receiving hoppers for the collating conveyor of the binding machine are spaced a substantial distance above the floor. This requires that a worker of average height standing on the floor lift the stacks over the shoulders in order to place the stacks in the receiver hoppers. Such lifting is in contradiction to OSHA standards. Moreover, repetitive placing of the signatures and fanning and massaging of the signatures over a long period of time can lead to carpal tunnel syndrome.

Machinery exists for automatically stripping signatures from a stack and for transporting the signatures to further processing apparatus. By way of example, Newsome U.S. Pat. No. 4,771,896 discloses a machine in which signatures in a stack are formed into a first running shingle having a rough and non-uniform setback between adjacent signatures in the shingle. The signatures of the first running shingle are collected in a stack and then are formed into a second running shingle having a substantially uniform setback which is significantly greater than that of the first shingle. In the patented machine, however, the flow of signatures through the machine is such that the second running shingle is disposed at a lower elevation than the first shingle. Thus, the machine does not readily lend itself to the loading of receiver hoppers which are located a substantial distance above a floor. Moreover, the ultimate output of the patented transporting machine is substantially continuous and is not precisely correlated with the demand requirements of the processing apparatus which is supplied by the machine.

SUMMARY OF THE INVENTION

The general aim of the present invention is to provide a new and improved signature transporting machine which significantly reduces the lifting effort required in order to load signatures into a receiver located at a relatively high elevation and, at the same time, eliminates the need of manually massaging and fanning the signatures prior to loading the signatures.

A more detailed object of the invention is to achieve the foregoing by providing a new and improved signature transporting machine in which signatures may be loaded into the machine at a relatively low elevation, are advanced upwardly at high speeds to the elevation of the receiver and, during the advance, are automatically stripped apart from one another and are precisely positioned so as to be discharged one-by-one into the receiver.

Another object of the invention is to estabish a signature stack in the receiver based on the demand of the receiver and of substantially consistent small height so as to promote uniform feeding of the signatures from the receiver.

Still a further object of the invention is to provide an accumulating hopper between the loading hopper and the receiver in order to enable a rough shingle of signatures elevated upwardly from the loading hopper to be converted into a uniform shingle for horizontal delivery to the receiver.

The invention also resides in the provision of unique means for effecting separation of individual signatures from one another and for controlling the stripping of signatures from the accumulating hopper in an intermittent but extremely smooth manner.

These and other objects and advantages of the invention will become more apparent from the following detailed description when taken in conjunction with the accompanying drawings.

BRIEF DESCRIPTION OF THE DRAWINGS

FIG. 9 is an enlarged view of one section of the machine illustrated in FIG. 3 with certain parts being broken away and with certain other parts being shown in cross-section.

FIGS. 10 and 11 are enlarged fragmentary cross-sections taken substantially along the lines 10—10 and 11—11, respectively, of FIG. 9.

FIG. 12 is a fragmentary cross-section taken substantially along the line 12—12 of FIG. 9.

DETAILED DESCRIPTION OF THE PREFERRED EMBODIMENT

Figure 1:
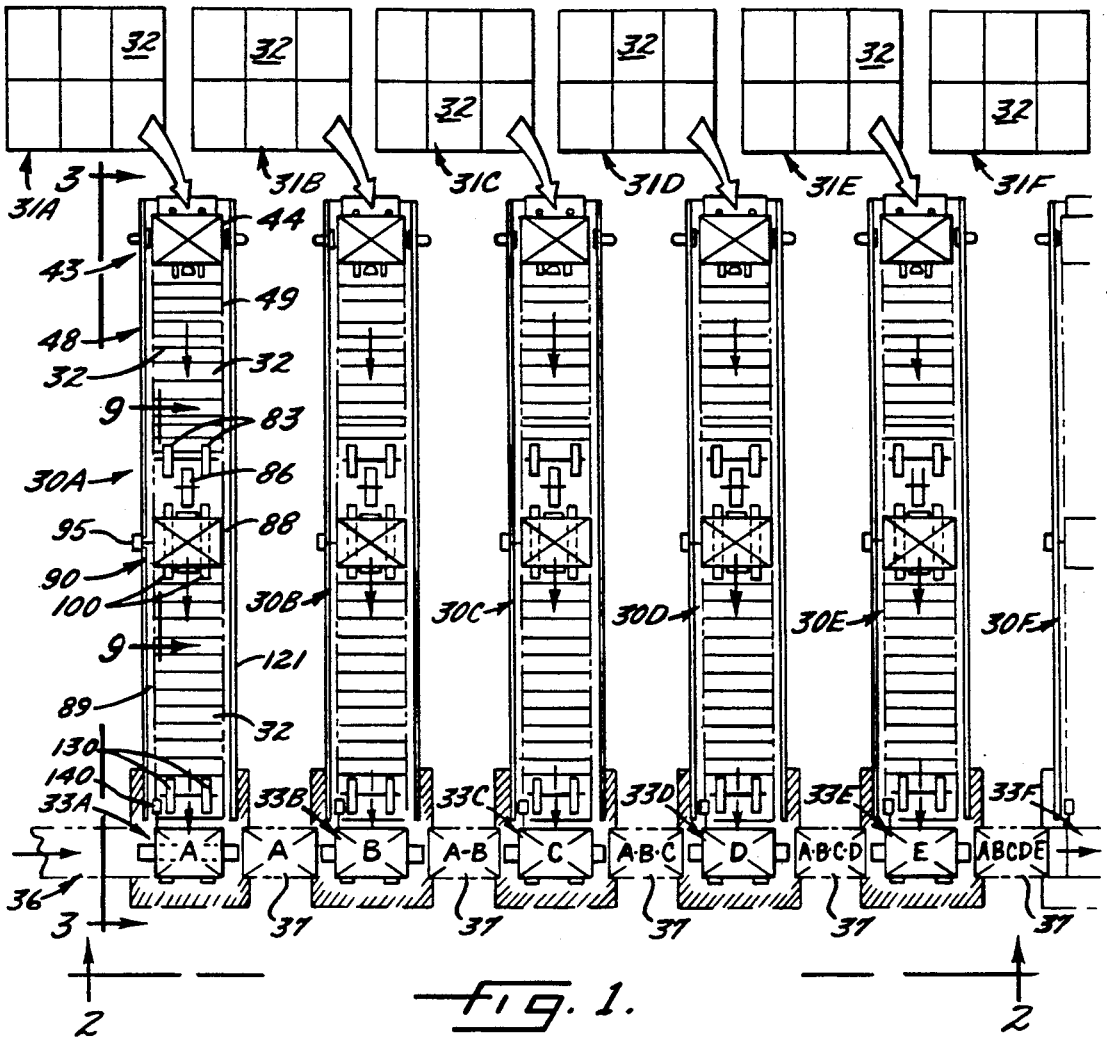
FIG. 1 is a diagrammatic floor plan showing several new and improved signatures transporting machines of the present invention installed in a typical bindery operation and feeding signatures to the collating conveyor of a binding machine.
Figure 2:
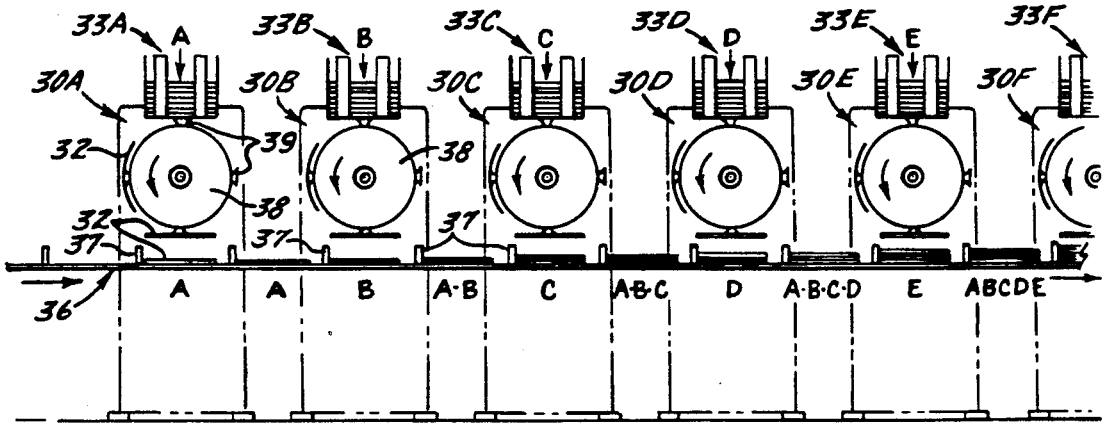
FIG. 2 is a diagrammatic front elevational view of the installation shown in FIG. 1 as seen along the line 2—2 of FIG. 1.

For purposes of illustration, several identical signature transporting machines 30A through 30F incorporating the features of the present invention have been shown in FIGS. 1 and 2 as installed in side-by-side relation on the floor of a magazine binding facility. Groups 31A through 31F of so-called signatures 32 are supplied to the binding facility from the printing operation on skids or pallets which are supported on the floor of the facility at the upstream ends of the machines. A signature typically is formed by four double-sided magazine pages which are folded along one margin called a spine.

The signatures 32 of the various groups 31A to 31F on the pallets are ultimately supplied to side-by-side receiver hoppers 33A through 33F (FIGS. 1 and 2) of a binding machine 35 (FIG. 3) having a conveyor 36 (FIGS. 1 to 3) for collecting and collating the signatures and for advancing the collated signatures to the binding section of the binding machine. The receiver hoppers 33 of the binding machine 35 are located above the collating conveyor 36 and typically have upper entrance ends which could be spaced more than five feet above the floor.

As shown diagrammatically in FIG. 2, the collating conveyor 36 includes a series of spaced pockets 37 adapted to be advanced continuously from left-to-right and adapted to receive the signatures 32 from the hoppers 33. In this instance, the signatures are transferred from the hoppers 33 to the pockets 37 by continuously rotated drum conveyors 38 each having suction cups 39 (FIG. 3) which, when at the twelve o'clock position, grip the underside of the lowermost signature in the overlying hopper. As each rotary drum is rotated counterclockwise (FIG. 2), the suction cups strip the signature from the hopper and then release the signature and drop the signature into an underlying bucket 37 as the cups reach the six o'clock position. As indicated diagrammatically in FIG. 1 and in somewhat schematic form in FIG. 2, a given bucket 37 receives a signature A upon moving past transport machine 30A, receives a signature B upon moving past transport machine 30B and so on until the bucket is filled with signatures from all of the transport machines. The collated signatures then are advanced by the bucket 37 to the binding section of the binding machine 35.

Because of the height of the receiver hoppers 33, difficulty is encountered by workers attempting to manually load signatures into the hoppers. A worker of average height standing on the floor must lift stacks of the signatures over the shoulders in order to place the signatures in the hoppers. As an incident to manually loading the signatures, the worker is required to fan and jog the signatures to prevent the newly inked signatures from sticking together during subsequent handling. Such lifting, fanning and jogging requires repeated flexing of the wrist and, after several months of labor, the worker may develop carpal tunnel syndrome.

In accordance with the present invention, each transporting machine 30 is constructed to enable loading of stacks of signatures 32 into the machine at a relatively low level, to elevate the signatures to the level of the receiver hopper 33 while advancing the signatures toward the hopper and, during such advance, to form the signatures into a uniform running shingle of relatively small thickness in order to effect separation of the signatures from one another so that the signatures may be deposited one at a time into the buckets 37 of the collating conveyor 36. The transporting machine 30 relieves the worker from lifting the stacks of signatures above shoulder level and avoids the need for the worker to fan the signatures so as to reduce worker fatigue and risk of injury. And, as will become more apparent subsequently, the machine 30 enables precise and trouble-free loading of the signatures into the hopper 33 at extremely high speeds.

Since the transporting machines 30A to 30F are identical, only the first machine 30A has been shown and will be described in detail. As shown most clearly in FIG. 3, the machine 30A includes a framework or base structure indicated generally by the reference numeral 40 and supported on wheels 41 which may be raised and lowered by hand-operated jacks 42 in order to enable the height of the machine 30A to be correlated with the height of a particular binding machine 35. Supported on the base 40 is a product hopper 43 adapted to hold a stack 44 of signatures 32 originating from the pallet-supported group 31A. The product hopper 43 is generally rectangular in cross-section and is formed by a pair of upright rear bars 45 (FIGS. 3, 4 and 5), a pair of upright side plates 46 and a pair of upright front bars 47. At their upper ends, the rear bars 45 and the side plates 46 are flared in order to widen the upper entrance end of the hopper 43 and facilitate loading of the signatures 32 into the hopper. Such loading is effected manually by a worker lifting a stack of signatures from group 31A on the pallets and by lowering the stack into the hopper from the upper end thereof. The entrance end of the hopper 43 usually is located less than 4½ feet above the floor and thus most workers may load the hopper without need of elevating the signatures above their shoulders. The worker need not massage, fan or jog the signatures prior to loading the hopper 43 but instead may simply place the roughly formed stack of signatures stored on the pallet into the hopper. One worker can usually keep the hoppers of three or four adjacent machines 30 in a loaded condition.

Figure 13:
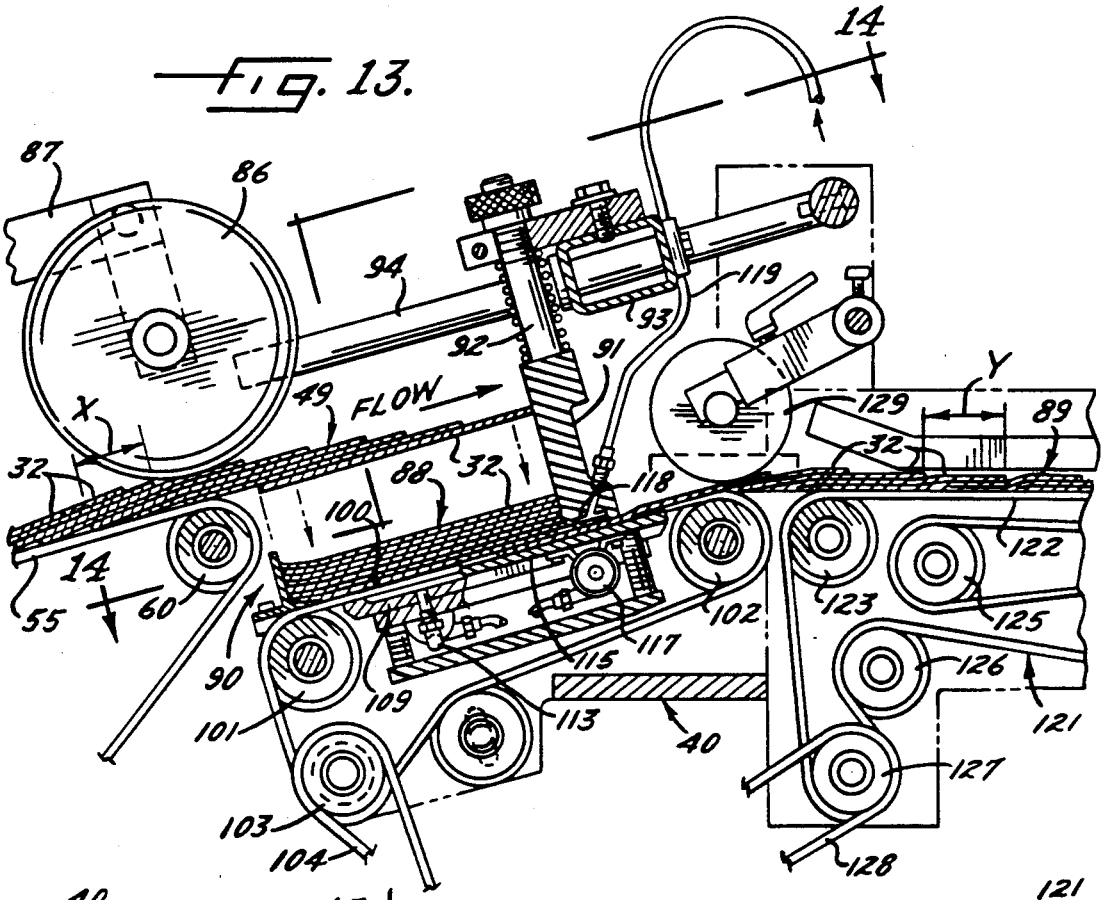
FIG. 13 is an enlarged view of the components shown by the right-hand portion of FIG. 9.

The bottom of the product hopper 43 is defined by an infeed conveyor 48 which strips the signatures 32 one-by-one from the lower end of the stack 44 in the hopper and forms the signatures into a first running shingle 49 (FIGS. 1, 9 and 13). As is well known, a shingle is a row of overlapping signatures which are arranged such that the trailing end portion of a leading signature underlies the leading end portion of the immediately trailing signature. The distance X (FIG. 13) between the leading edges of adjacent signatures is commonly called the shingle setback. In the case of the first running shingle 49, the setback is rough and non-uniform and is relatively small (e.g., on the order of ½" to 1"). Accordingly, each signature underlies several other signatures and thus the overall shingle is relatively thick.

Herein, the infeed conveyor 48 is formed in part by six laterally spaced rubber belts 50 to 55. The belts are trained around an upstream sheave 56 (FIG. 5) located adjacent the front of the hopper 43 and have upper active runs which extend generally horizontally beneath the stack 44 of signatures 32 in the hopper. The active runs of the belts proceed forwardly and generally horizontally from the hopper 43 and then curve upwardly around a rotatable drum-like sheave 57 (FIGS. 3 and 10) and proceed vertically for a substantial distance. Thereafter, the belts encounter a second rotatable drum-like sheave 58 where the active runs of the two center belts 52 and 53 terminate. As shown in FIG. 9, the two center belts loop approximately 180° around the sheave 58 and then proceed to a sheave 59. The four outboard belts 50, 51 and 54, 55, however, proceed upwardly and forwardly to a sheave 60 where the active runs of the four outboard belts terminate. After curving around the sheave 60, the four outboard belts 50, 51 and 54, 55 curve around the sheave 59 and rejoin the center belts 52 and 53. All six belts then curve around sheaves 61, 62 and 63 prior to returning to the sheave 56.

Driving of the belts 50 to 55 is effected by rotating the sheave 61. For this purpose, a motor 64 (FIG. 3) acts through a speed reducer 65 and a chain 66 to drive the input of an electrically controlled clutch 67. A chain 68 is connected to the output of the clutch and is trained around a sprocket which is connected to rotate with the sheave 61. The belts 50 to 55 are driven whenever the clutch 67 is engaged and are stopped when the clutch is disengaged.

Figures 5, 6:
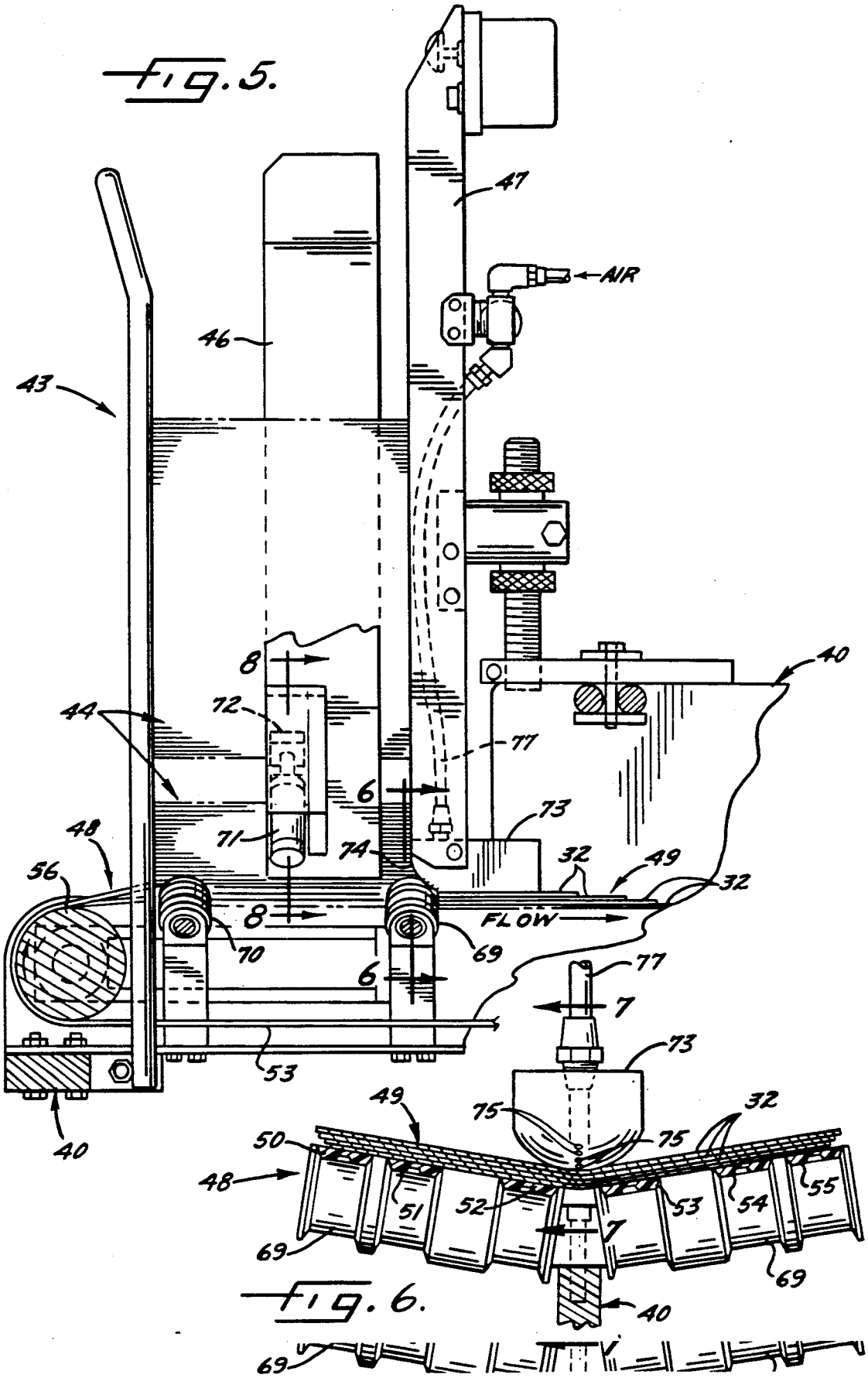
FIG. 5 is a fragmentary cross-section taken substantially along the line 5—5 of FIG. 4.
FIG. 6 is an enlarged fragmentary cross-section taken substantially along the line 6—6 of FIG. 5.

As shown in FIGS. 5 and 6, front and rear pairs of mutually inclined rollers 69 and 70 are located beneath the hopper 43 adjacent the front and rear ends thereof, respectively. The upper active runs of the belts 50 to 55 pass across the rollers and, as the active runs pass from the rollers of the rear pair 70 to the rollers of the front pair 69, they are formed into a V-shaped configuration as shown in FIG. 6. Signatures 32 at the lower end portion of the stack 44 are forced against the belts and into the same V-shaped configuration by the weight of the signatures in the upper portion of the stack. By thus bowing the signatures upwardly, the signatures tends to separate from one another to facilitate stripping of the lowermost signature from the stack by the belts.

Figure 8:
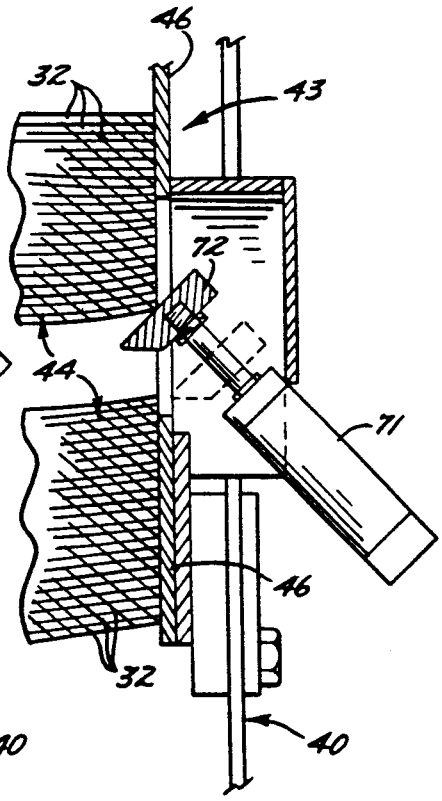
FIG. 8 is an enlarged fragmentary cross-section taken substantially along the line 8—8 of FIG. 5.

Stripping of individual signatures 32 from the stack 44 also is facilitated by reducing the weight on the lowermost signatures. For this purpose, two reciprocating pneumatic actuators 71 (FIGS. 4 and 8) are located adjacent the side plates 46 of the hopper 43 and their rods carry lifting shoes 72. When the rods are extended, the shoes move into the stack 44 as shown in solid lines in FIGS. 4 and 8 and thereby lift the upper portion of the stack so as to relieve the weight thereof from the lower portion of the stack. Periodically, each shoe is retracted just momentarily to the position shown in phantom lines in FIGS. 4 and 8 in order to enable the upper portion of the stack to drop and replenish the lower portion. The shoes are then advanced back to their active positions to once against raise the upper portion of the stack. Actuation of the shoes is timed in accordance with the maximum output of the machine 30 and the timing is such that the shoes are never held in their active positions for so long as to permit the lower portion of the stack 44 to become completely depleted.

Figure 7:
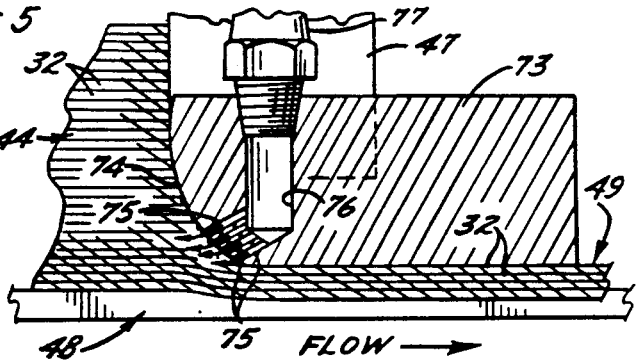
FIG. 7 is an enlarged fragmentary cross-section taken substantially along the line 7—7 of FIG. 6.

As the signatures 32 approach the lower end portion of the stack 44, they are aerated and lubricated to enable the signatures to separate clearly and at high velocity. To this end, a large air nozzle 73 (FIGS. 6 and 7) having the general shape of a shoe is positioned at the front side of the hopper 43 adjacent the front pair of rollers 69. The nozzle is centered between the two middle belts 52 and 53 and is positioned in light overlying contact with the shingle 49 emerging from the hopper 43. The rear end portion of the nozzle is formed with a spherically rounded nose 74 (FIG. 7) having several downwardly and rearwardly angled discharge passages 75 which communicate by way of a larger passage 76 and an air line 77 with a source of pressurized air. Pressurized air jets shoot out of the passages 75 and lubricate adjacent faces of adjacent signatures 32 in the lower end portion of the stack 44 so as to prevent the signatures from sticking together and to help insure that no more than one signature at a time is stripped from the stack.

In carrying out the invention, the rough running shingle 49 formed by the signatures 32 from the stack 44 is elevated from a level at the lower end of the stack to a significantly higher level shortly after the shingle is formed. For this purpose, two laterally spaced rubber nip belts 78 (FIGS. 9 and 12) are trained around the drum-like sheave 57 and around idler sheaves 79 located above the sheave 57. The active runs of the nip belts 78 extend generally vertically and are disposed in spaced face-to-face relation with the vertically extending portions of the active runs of the second outermost belts 51 and 54 of the series of belts 50 to 55. During driving of the belts 50 to 55, the shingle 49 of signatures 32 is pinched by the second outermost belts 51 and 54 against the nip belts 78 and the sheave 57 as the belts curve around that sheave. As a result, the shingle 49 is guided from a horizontal advance to a vertical advance and is forced to move upwardly by virtue of being held in pinched relation between the belts 51 and 54 and the nip belts 78 as the belts travel vertically toward the sheave 58. When the shingle 49 approaches the sheave 58, it is pinched by the nip belts 78 against the second outermost belts 51 and 55 and against the sheave 58 and then is advanced around that sheave by the four belts 50, 51 and 54, 55. The sheaves 79 are carried on arms 80 and 81 (FIGS. 9 and 12) which are pivotally connected to the base 40 at 82 and which may be swung to an inactive position shown in phantom lines in FIG. 9 so as to enable the nip belts 78 to be moved away from the belts 50 to 55 for the purpose of clearing any jams that might occur.

Immediately downstream of the drum-like sheave 58 are two laterally spaced nip rollers 83 (FIGS. 9 and 12) which are carried by a rod 84 connected to a mounting shaft 85 for the sheaves 79. A larger diameter nip roller 86 is located downstream of and is centered between the rollers 83 and is carried by an arm 87 which, in turn, is connected to the arm 81. As the active runs of the belts 50, 51 and 54, 55 proceed upwardly and forwardly from the sheave 58, the rollers 83 and 86 pinch the signatures 32 against the belts and maintain control over the signatures.

Figure 14:
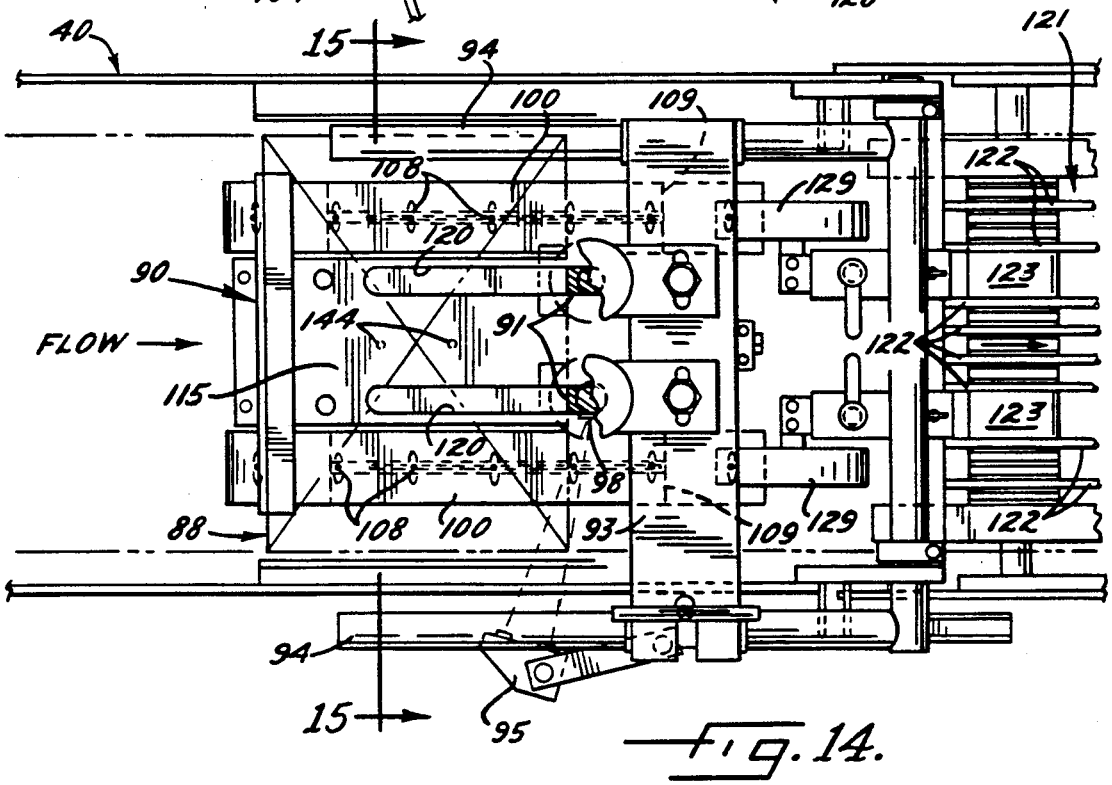
FIG. 14 is a fragmentary top plan view as seen along the line 14—14 of FIG. 13.

Pursuant to the invention, the signatures 32 in the rough and non-uniform shingle 49 are collected in a second stack 88 and then are advanced to the receiver hopper 33 in the form of a second running shingle 89 (FIGS. 1 and 13) having a substantially uniform setback Y (FIG. 13) which is substantially greater than the setback of the first shingle, the setback Y being on the order of 4". As shown most clearly in FIG. 13, the nip roller 86 is located immediately above the sheave 60 where the active runs of the belts 50, 51 and 54, 55 terminate. Located below and immediately downstream of the sheaves 60 and 86 is an accumulating hopper 90 in which the signatures 32 of the first shingle 49 are temporarily collected in the stack 88. As the signatures are propelled from beneath the nip roller 86 by the belts 50, 51 and 54, 55, they strike two laterally spaced upright shoes 91 (FIGS. 13 and 14) at the forward end of the hopper 90 and drop downwardly into the hopper. The shoes 91 are carried on the lower ends of spring-loaded rods 92 which are attached to a crossbar 93 supported by two cantilevered arms 94.

The signatures 32 in the stack 88 are stripped from the lower end thereof and are formed into the second shingle 89. Advantageously, the height of the stack 88 is kept relatively short in order to keep the weight of the stack low and allow free and consistent stripping of the signatures from the bottom of the stack. This is achieved by effecting an on-demand feed of signatures into the hopper 90 and preferably by stopping the infeed conveyor 48 when the supply of signatures in the hopper is adequate and then by restarting the infeed conveyor when the height of the stack 88 falls below a predetermined level.

Figure 15:
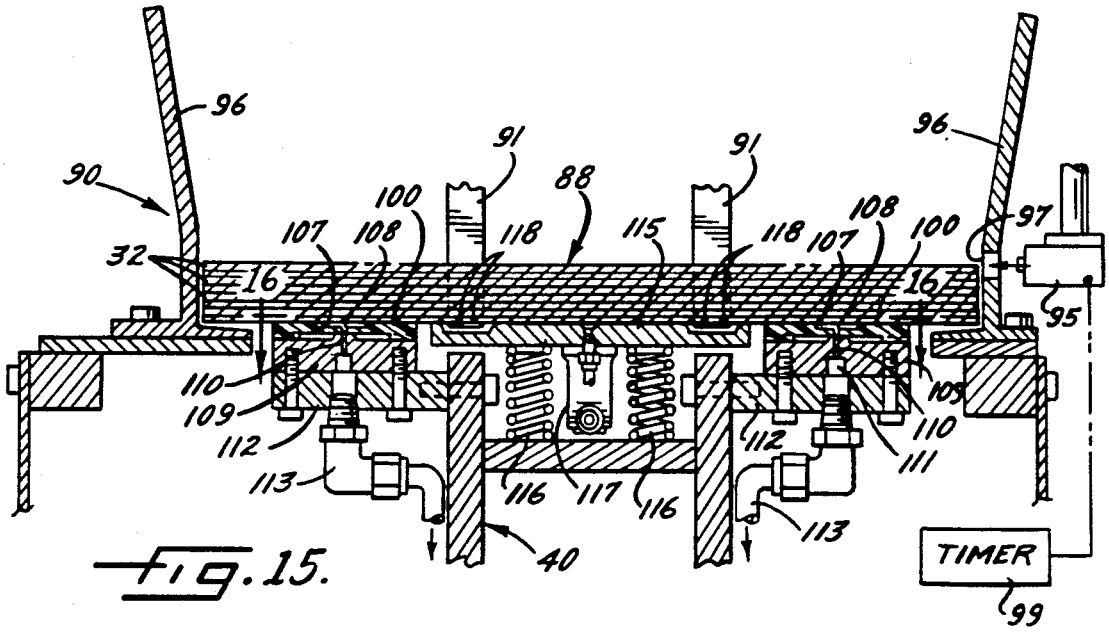
FIG. 15 is an enlarged fragmentary cross-section taken substantially along the line 15—15 of FIG. 14.

Specifically, the transmitter of a photoelectric cell 95 (FIG. 15) is located adjacent one of the sidewalls 96 of the topper 90 and directs a beam of light through an opening 97 in that sidewall. Supported on the outboard side of the adjacent shoe 91 is a reflector 98 (FIG. 14) which is positioned in the path of the beam. As long as the signatures 32 in the stack 88 are above a predetermined level (e.g., one inch), the signatures interrupt the light beam and prevent the beam from striking the reflector. When the signatures fall below such level, the beam is reflected back to the photocell by the reflector and causes the photocell to produce an electrical signal. Such signal is relayed to the electrically controlled clutch 67 and effects engagement of the clutch so as to cause driving of the infeed conveyor 48 and feeding of signatures into the hopper 90. In this particular instance, a timer 99 (FIG. 15) also is set by the signal from the photocell 95 and, after the elapse of a predetermined period of time, the timer times out to effect disengagement of the clutch 67 and interruption of the drive to the infeed conveyor 48. Driving of the infeed conveyor thus occurs intermittently in short bursts, the timer being set such that each driving interval is sufficiently long as to insure against complete depletion of the signatures in the hopper 90. If desired, the actuators 71 may be operated to advance the lifting shoes 72 to their active positions when the infeed conveyor starts so as to relieve the pressure from the lower portion of the stack 44 during stripping of the signatures from that stack.

A continuously driven conveyor is used to strip the signatures 32 from the stack 88 in the hopper 90. The conveyor is formed by a laterally spaced pair of endless rubber belts 100 (FIGS. 13 to 17 and FIG. 20) which are trained around and tensioned between sheaves 101, 102 and 103 (FIG. 13). A drive belt 104 also is associated with the sheaves 103 and is trained around a sheave 105 (FIG. 9). Associated with the sheave 105 is a drive chain 106 which extends from the speed reducer 65. Accordingly, the belts 100 are driven by way of the chain 106 and the belt 104 whenever the motor 64 is energized. Continuous driving of the belts 100 is effected at a substantially constant speed.

Figure 3:
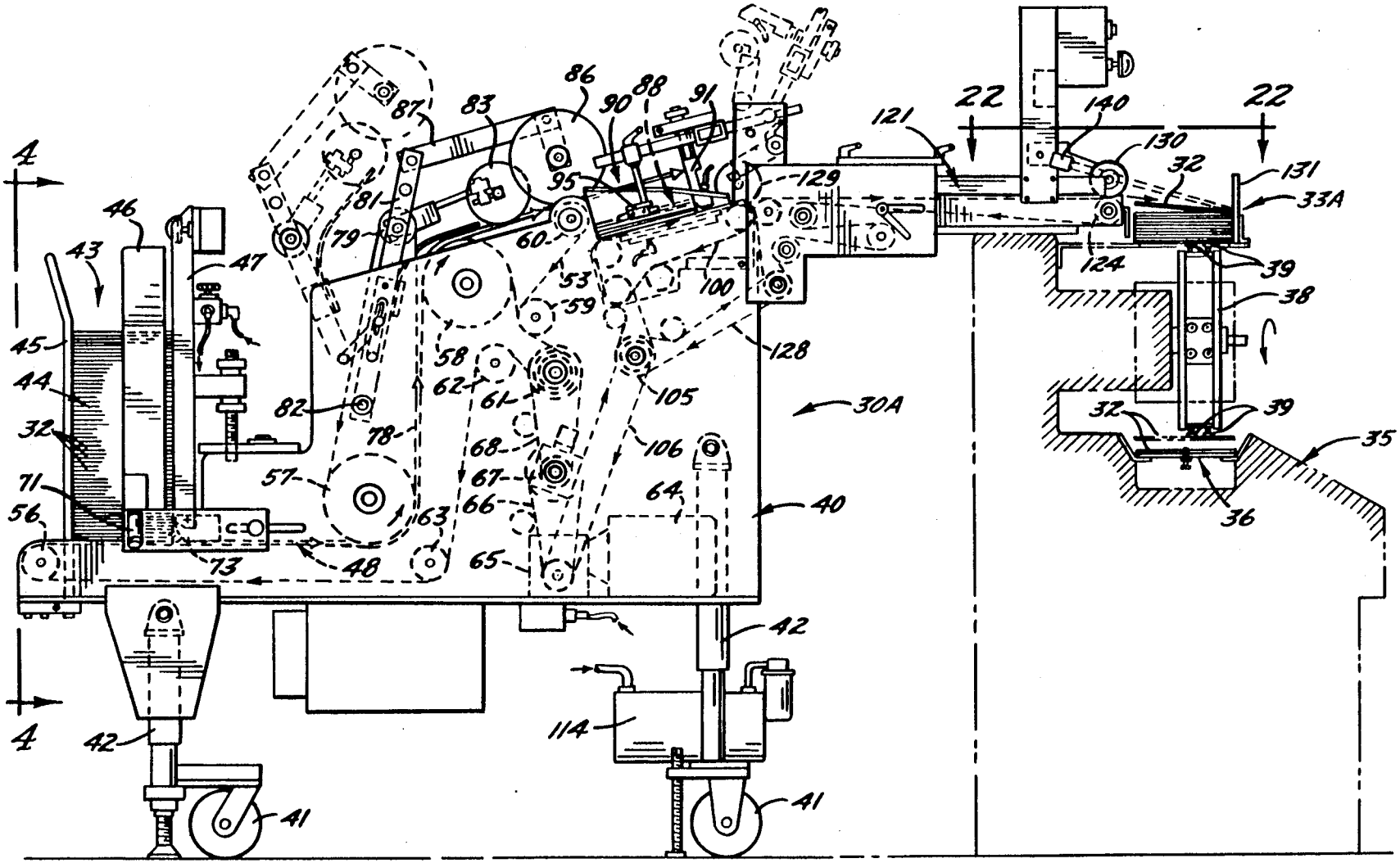
FIG. 3 is an enlarged side elevational view of one of the transporting machines as seen along the line 3—3 of FIG. 1.
Figure 4:
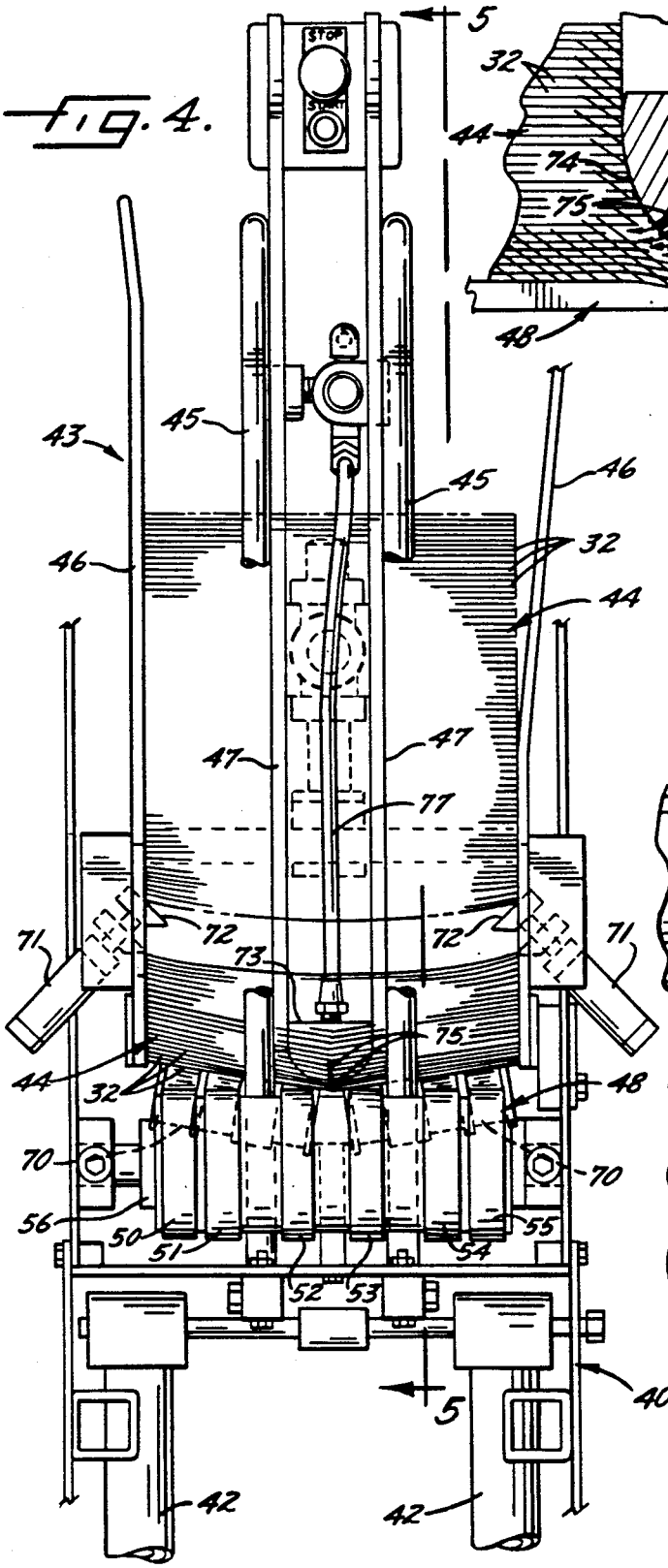
FIG. 4 is an enlarged fragmentary rear elevational view of one of the transporting machines as seen along the line 4—4 of FIG. 3.

The upper active runs of the belts 100 extend upwardly and forwardly beneath the lowermost signature 32 in the stack 88 (see FIG. 13). As shown most clearly in FIG. 20, laterally elongated pockets 107 are formed in and are spaced along the active face of each belt 100, each pocket communicating with a hole or passage 108 (FIG. 19) formed through the belt. The upper active run of each belt 100 overlies and runs along the top of an elongated plate 109 (FIGS. 16, 17 and 19) which defines a vacuum plenum. A vertical slit 110 is formed in the upper surface of each plate 109 along almost the entire length thereof and communicates with a chamber 111 (FIG. 17) formed in the plate and closed by a lower plate 112. A passage 112*a* is formed through each lower plate and is connected to a line 113 which leads to a vacuum pump 114 (FIG. 3). When the line 113 is subjected to vacuum, suction is created at the pockets 107 of the associated belt 100 via the passage 112*a*, the chamber 111, the slit 110 and the passages 108. As the belts 100 travel beneath the stack 88, the suction clutches the lowermost signature 32 in the stack to the belts so as to cause the belts to strip the signature from the stack and to advance the signature forwardly from the stack.

To promote separation of the signatures 32 in the stack 88, the signatures are continuously jogged or vibrated. Thus, a vibratory plate 115 (FIGS. 15 and 16) is located between the belts 100 and beneath the stack 88 and is supported near its corners by four coil springs 116 on the base 40. Front and rear air-actuated vibratory units 117 are mounted on the underside of the plate 115 and, when operated, cause the plate to shake at high frequency in order to jostle the signatures 32 and promote their release from one another in the stack 88.

Figure 18:
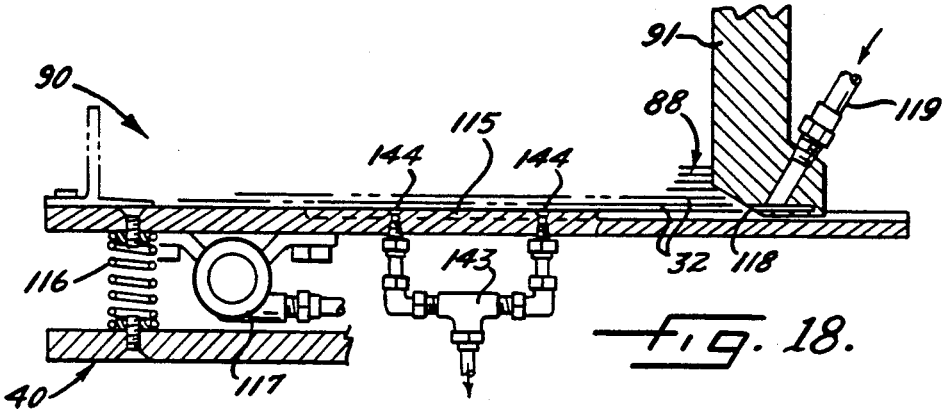

Pressurized air is also used to lubricate the signatures 32 in the stack 88 and thus facilitate their release from one another. Thus, passages 118 (FIGS. 18 and 19) are formed through the lower end portions of each shoe 91 and communicate with a pressurized air source via a flexible line 119. Air jets discharged from the passages 118 fluff the leading end portions of the lowermost signatures 32 in the stack 88 to assist the belts 100 in consistently stripping only one signature at a time from the stack.

Figure 16:
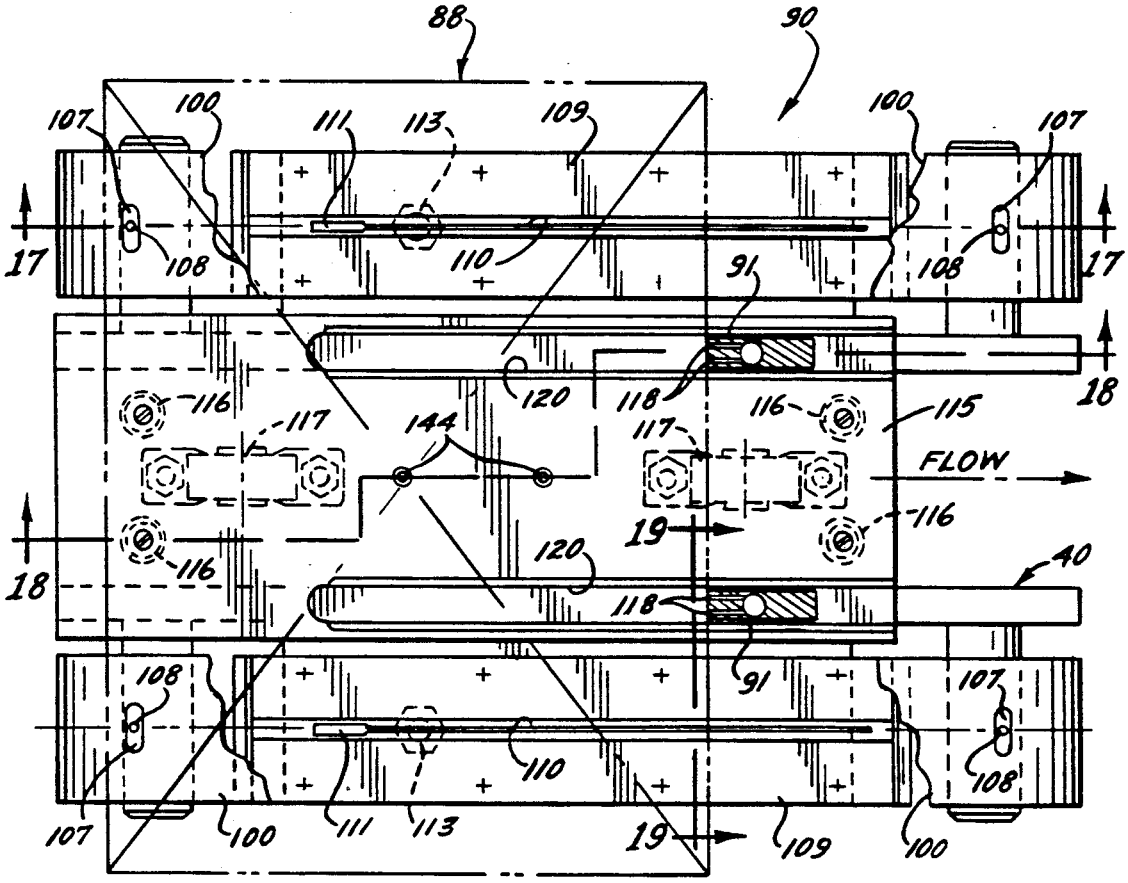
FIG. 16 is a top plan view as seen substantially along the line 16—16 of FIG. 15 with certain components broken away for clarity of illustration.
Figure 17:
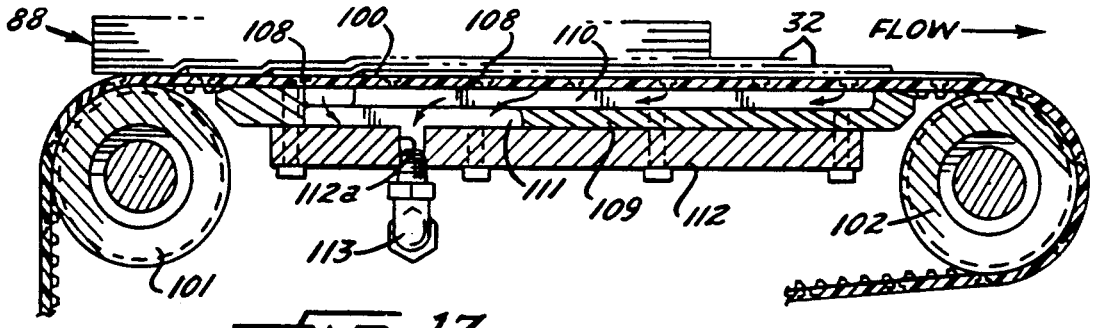
FIGS. 17, 18 and 19 are fragmentary cross-sections taken substantially along the lines 17—17, 18—18 and 19—19, respectively, of FIG. 16.
Figure 19:
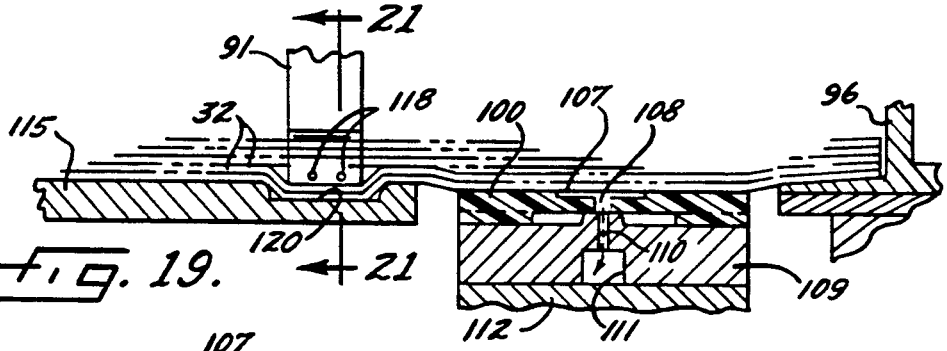
Figure 20:
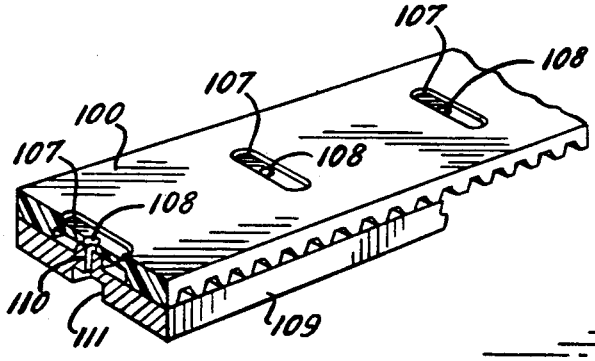
FIG. 20 is a fragmentary perspective view of certain components shown in FIG. 19.
Figure 21:
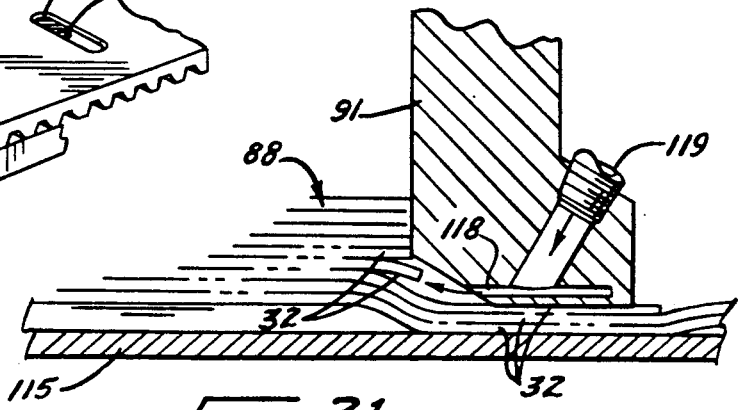
FIG. 21 is an enlarged fragmentary cross-section taken substantially along the line 21—21 of FIG. 19.

As shown most clearly in FIGS. 16 and 19, the lower end portions of the shoes 91 are located in elongated channels 120 formed in the upper side of the vibratory plate 115. As each signature 32 is advanced forwardly from the stack, the shoes press laterally spaced portions cf the signature into the channels and iron shallow dimples into the signature.

Figure 22:
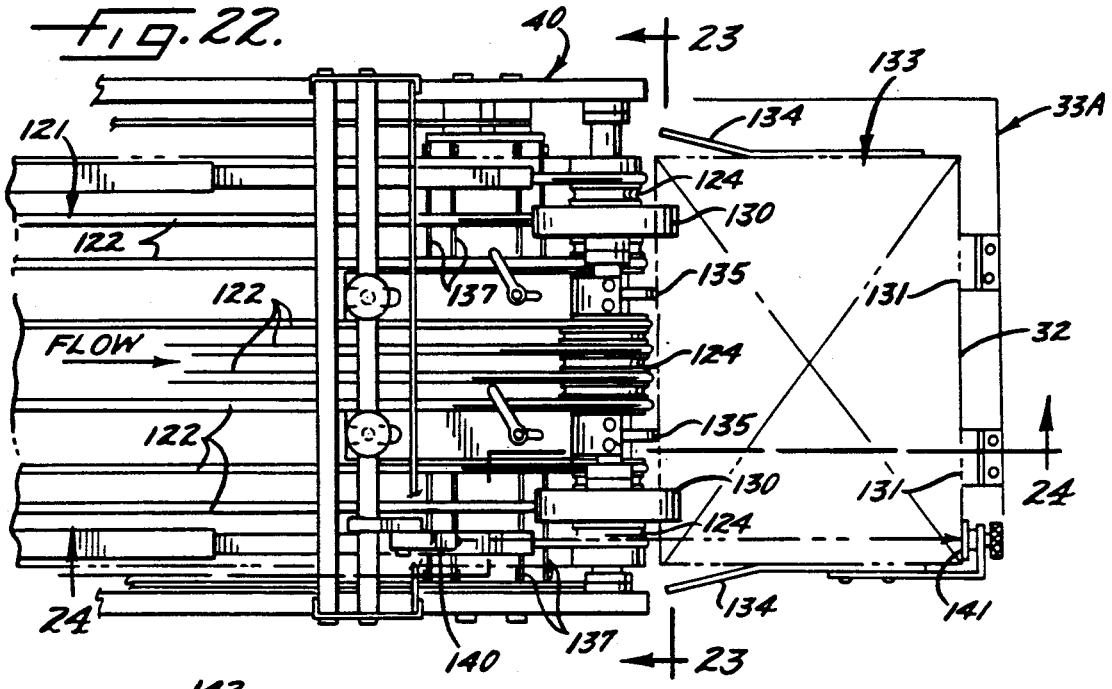
FIG. 22 is an enlarged fragmentary top plan view as seen along the line 22—22 of FIG. 3.
Figure 23:
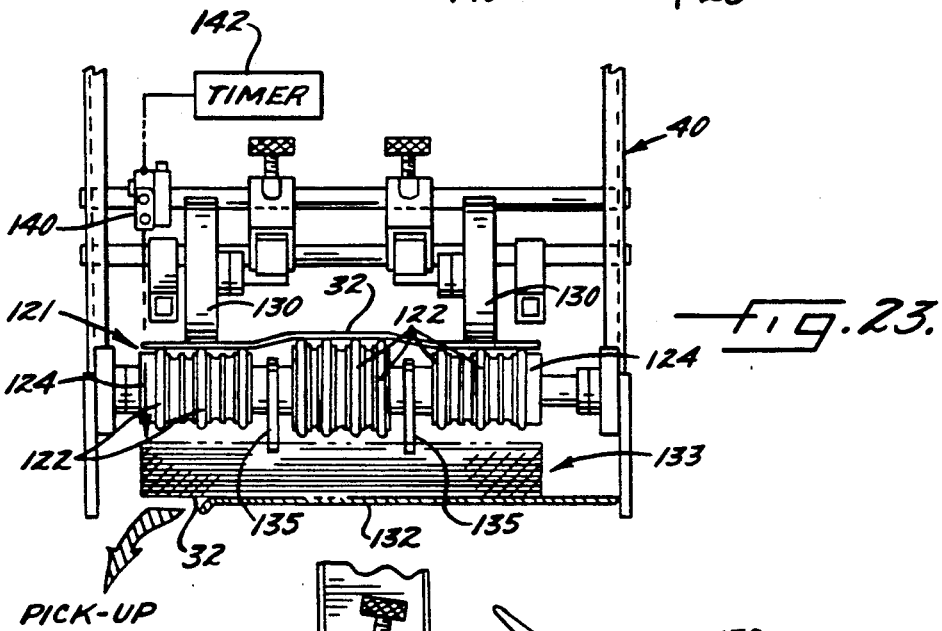
FIG. 23 is a fragmentary front elevational view as seen along the line 23—23 of FIG. 22.
Figure 24:
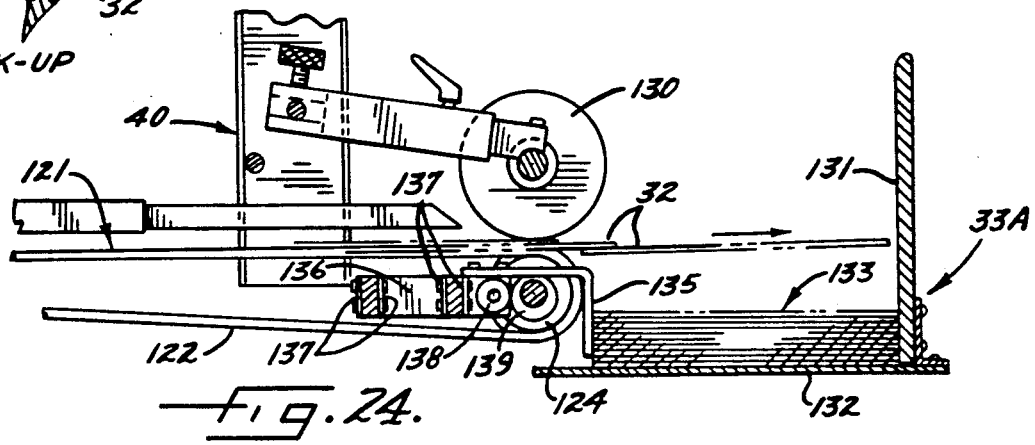
FIG. 24 is a fragmentary cross-section taken substantially along the line 24—24 of FIG. 22.

Signatures 32 stripped from the stack 88 by the vacuum belts 100 are transferred to an outfeed conveyor 121 for delivery to the receiving hopper 33A of the binding machine 35. As shown most clearly in FIGS. 14, 22 and 23, the outfeed conveyor includes a series of ten laterally spaced 0-ring type rubber belts 122 which are spaced laterally from one another. The active upper runs of the belts 122 begin at sheaves 123 (FIG. 13) located just downsteam of the sheaves 102 of the vacuum belts 100. The active runs of the belts 122 extend horizontally and terminate at sheaves 124 (FIGS. 22 to 24) located at the rear side of and about at the same level as the upper entrance end of the receiving hopper 33A. From the sheaves 124, the belts 122 loop around sheaves 125, 126 and 127 (FIG. 13) before returning to the sheaves 123. A drive belt 128 (FIGS. 9 and 13) is associated with the sheaves 127 and extends to the sheave unit 105 which is driven by the drive chain 106. Accordingly, the belts 122 of the outfeed conveyor 121 also are driven continuously and at a substantially constant speed.

As the signatures 32 exit the vacuum belts 100 and pass to the outfeed belts 122, they are pressed against the vacuum belts by a pair of nip rollers 129 (FIGS. 13 and 14) located above the sheaves 102. Two laterally spaced nip rollers 130 (FIGS. 22 to 24) also are located above the outboard ones of the sheaves 124 and press the signatures 32 against two of the belts 122 just before the signatures fly off of the downstream end of the belts. As each signature leaves the belts, its leading end strikes a pair of upwardly extending posts 131 (FIGS. 22 and 24) which define the forward end of the hopper 33A. The signatures then fall toward the bottom 132 of the hopper and collect in a stack 133 between the sidewalls 134 of the hopper.

To advantage, the trailing edges of the signatures 32 in the stack 133 are repeatedly tapped to force the signatures forwardly against the posts 131 and keep the stack uniformly arranged. For this purpose, two laterally spaced fingers 135 (FIGS. 23 and 24) extend downwardly into the hopper 33A behind the stack 133. Each finger is carried by a mounting bracket 136 which is supported on the base 40 by leaf springs 137. A follower 138 on each bracket 136 engages an eccentric cam 139 which is rotatable with a mounting shaft for the sheaves 124. As the cams rotate, they force the brackets 136 and the fingers 135 rearwardly and then the springs 137 return the brackets and fingers forwardly. During the forward return strokes, the fingers tap against the rear of the stack 133 to push the signatures 32 against the posts 131 and keep the signatures in stacked alignment.

As discussed previously, the signatures 32 in the stack 133 are stripped one-by-one out of the receiver hopper 33A by the suction cups 39 of the rotary conveyor 38 and are deposited into the pockets 37 of the collating conveyor 36. To insure consistent and uniform stripping of only one signature at a time, the weight of the stack 133 is kept low by keeping the height of the stack short. Again, this is achieved by detecting the height of the stack 133 and by triggering the flow of signatures into the receiving hopper 33A when the stack falls below a predetermined level.

To detect the height of the stack 133, a photocell 140 (FIGS. 3 and 23) is mounted on a fixed structure upstream of the hopper 33A and directs a light beam toward a reflector 141 (FIG. 22) at the forward end of the hopper. When the stack 133 is above a preselected level, the stack prevents the beam from striking the reflector. As the stack falls below the reflector, reflection of the beam back to the photocell 140 causes the latter to produce an electrical signal. In this case, the signal is employed to initiate the application of vacuum to the vacuum belts 100 so that the belts may strip signatures 32 from the stack 88 in the hopper 90. The signal from the photocell 140 also is used to set a timer 142 (FIG. 23) which, upon timing out after the elapse of a preselected period of time, causes the vacuum to be cut off from the belts 100. When the vacuum is cut off from the belts 100, vacuum is simultaneously applied, via piping 143 (FIG. 18), to two passages 144 formed through the vibratory plate 115 and opening out of the upper surface thereof. Such vacuum clutches the lowermost signature 32 in the stack 88 downwardly against the plate 115 and prevents that signature from being stripped out of the stack due to the frictional force of the belts 100. Accordingly, even though the belts 100 continue to run, they are incapable of stripping signatures 32 from the stack 88 as a result of the vacuum being released from the belts and as a result of the lowermost signature being firmly clutched against the plate 115.

When the photocell 140 triggers the application of vacuum to the belts 100, the timer 142 times out a very short interval thereafter so as to cut off the feeding of signatures 32 from the stack 88 to the hopper 33A. Accordingly, the signatures are fed to the hopper 33A in very short bursts in order to keep the height, and thus the weight, of the stack 133 low. The stack 133 is kept at a height of between one to four inches, selectively, and, as a result, the signatures are not significantly compressed by their own weight and thus may be stripped consistently and individually from the hopper 33A by the rotary conveyor 38.

From the foregoing, it will be apparent that the present invention brings to the art a new and improved signature transporting machine 30 which may be loaded by a worker without need of the worker lifting the signatures 32 above shoulder level. The hopper 90 serves as an accumulator between the loading hopper 43 and the receiving hopper 33 and avoids the need of maintaining precise control over the signatures as the signatures are elevated upwardly as a first running shingle 49 from the lower end of the hopper 43. Thus, the infeed conveyor 48 enables the signatures to be elevated to temporary storage in the hopper 90 so that the vacuum belts 100 and the outfeed conveyor 121 may establish precise setback of the relatively thin second shingle 89 of signatures, separation of the signatures from sticking, and horizontal feeding of the signatures to the hopper 33 without concern about elevating the signatures. Because of the thinness of the shingle 89 and because the weight levels in the hoppers 90 and 33 are kept low, the tendency for the signatures to stick to one another and feed two or three at a time is virtually eliminated and thus the worker need not fan or massage the signatures to prevent sticking.

I claim:

1. A machine for supplying signatures to a receiver having an upper entrance end spaced a predetermined distance above a floor, said machine comprising a hopper into which an upright stack of signatures is initially loaded, said hopper being located upstream of said receiver and having a lower end which is located a substantial distance below the entrance end of said receiver, first conveyor means for stripping said signatures one-by-one from the lower end of said stack and for advancing said signatures downstream from said hopper as a running shingle, said signatures being elevated from a low level at the bottom of said stack to a higher level by said first conveyor means as the signatures are advanced downstream from said hopper, means located between said hopper and said receiver for collecting the signatures from said first conveyor means after the signatures have been elevated and for forming said signatures into a second upright stack, means for driving said first conveyor means intermittently, said first conveyor means being idle during at least part of the time that the top of said second stack is above a predetermined level, means responsive to the height of said second stack for starting said first conveyor means when the top of the second stack falls below said predetermined level, second conveyor means for stripping said signatures one-by-one from the lower end of said second stack and for advancing said signatures toward said receiver, said second conveyor means having a discharge end located at least as high as the entrance end of said receiver and discharging the signatures one-by-one into said receiver, means for driving said second conveyor means at a substantially constant speed, means for disabling said second conveyor means for stripping signatures from said second stack during at least part of the time that the height of the signatures in said receiver is above a preselected level, and means for causing said second conveyor means to start stripping signatures from said second stack when the height of the signatures in said receiver falls below said preselected level.

2. A machine as defined in claim 1 in which said first conveyor means stop a predetermined time after being started.

3. A machine as defined in claim 2 in which said second conveyor means is disabled a predetermined time after said second conveyor means starts stripping signatures from said second stack.

4. A machine as defined in claim 1 in which said second conveyor means comprise a belt, means for selectively applying vacuum to said belt to cause said belt to clutch and strip signatures from said second stack and for selectively releasing vacuum from said belt to disable the stripping ability of the second belt, a fixed plate underlying said second stack, and means for applying vacuum to said fixed plate when the vacuum is released from said belt whereby the lowermost signature in the second stack is clutched to said plate and is prevented from being frictionally stripped from the second stack by said belt.

5. A machine as defined in claim 4 further including means for vibrating said plate thereby to jog the signatures in said second stack.

6. A machine as defined in claim 1 further including means for lifting a group of upper signatures in said first stack upwardly from the underlying signatures in the first stack, for periodically lowering the upper group of signatures onto the underlying signatures, and for thereafter lifting a different group of upper signatures in the first stack upwardly from the underlying signatures in the first stack.

7. A machine as defined in claim 1 further including means for periodically tapping the upstream ends of the signatures in said receiver thereby to keep such signatures in a neatly organized stack in said receiver.

8. A machine for supplying signatures to a receiver having an upper entrance end spaced a predetermined distance above a floor, said machine comprising a hopper into which an upright stack of signatures is initially loaded, said hopper being located upstream of said receiver and having a lower end which is located a substantial distance below the entrance end of said receiver, conveyor means for stripping said signatures one-by-one from the lower end of said stack and for advancing said signatures downstream from said hopper as a running shingle, means for lifting a group of upper signatures in said stack upwardly from the underlying signatures in the stack thereby to reduce the weight of the signatures on said conveyor means during stripping of said signatures from said stack by said conveyor means, said signatures being elevated from a low level at the bottom of said stack to a higher level by said conveyor means as the signatures are advanced downstream from said hopper, and means downstream of said conveyor means and located at least as high as the entrance end of said receiver for discharging the signatures one-by-one into said receiver.

9. A machine as defined in claim 8 in which said lifting means periodically drop said group of upper signatures onto the underlying signatures in said stack and thereafter lift a different group of upper signatures in said stack from the underlying signatures in the stack.

10. A machine as defined in claim 9 including means for intermittently driving said conveyor means, said lifting means holding a group of upper signatures in said stack upwardly and relieving the weight of such upper signatures on the underlying signatures during driving of said conveyor means.

11. A machine as defined in claim 8 further including means located downstream of said stack adjacent the lower end thereof and directing jets of pressurized air in an upstream direction and toward the stack to lubricate adjacent faces of adjacent signatures in the lower end portion of said stack.

* * * * *